US005856051A

United States Patent [19]

Yau et al.

[11] Patent Number: 5,856,051

[45] Date of Patent: Jan. 5, 1999

[54] WATER-RESISTANT PROTECTIVE OVERCOAT FOR AGX PHOTOGRAPHIC SYSTEM

[75] Inventors: Hwei-ling Yau, Rochester; Wendy S. Krzemien, Hilton; Christine J. T. Landry-Coltrain, Fairport; Wayne A. Bowman, Walworth, all of N.Y.

[73] Assignee: Eastman Kodak Company, Rochester, N.Y.

[21] Appl. No.: 898,985

[22] Filed: Jul. 23, 1997

[51] Int. Cl.[6] ..... G03C 1/78; G03C 1/76

[52] U.S. Cl. ..... 430/14; 430/273.1; 430/537

[58] Field of Search ..... 430/523, 531, 430/533, 14, 273.1, 537

[56] References Cited

U.S. PATENT DOCUMENTS

| | | | |
|---|---|---|---|
| 2,173,480 | 9/1939 | Jung | 88/19.5 |
| 2,259,009 | 10/1941 | Talbot | 88/19.5 |
| 2,331,746 | 10/1943 | Talbot | 88/19.5 |
| 2,706,686 | 4/1955 | Hilborn | 95/8 |
| 2,798,004 | 7/1957 | Weigel | 117/2 |
| 3,113,867 | 12/1963 | Van Norman et al. | 96/87 |
| 3,190,197 | 6/1965 | Pinder | 95/1 |
| 3,397,980 | 8/1968 | Stone | 430/14 |
| 3,415,670 | 12/1968 | McDonald | 117/10 |
| 3,443,946 | 5/1969 | Grabhofer et al. | 96/50 |
| 3,502,501 | 3/1970 | Burczyk et al. | 117/34 |
| 3,697,277 | 10/1972 | King | 96/50 |
| 3,733,293 | 5/1973 | Gallagher et al. | 260/29.6 |
| 4,092,173 | 5/1978 | Novak et al. | 96/119 |
| 4,171,979 | 10/1979 | Novak et al. | 96/119 |
| 4,333,998 | 6/1982 | Leszyk | 430/12 |
| 4,426,431 | 1/1984 | Harasta et al. | 430/14 |
| 4,999,266 | 3/1991 | Platzer et al. | 430/14 |
| 5,179,147 | 1/1993 | Jones | 524/261 |
| 5,447,832 | 9/1995 | Wang et al. | 430/523 |
| 5,529,891 | 6/1996 | Wang et al. | 430/533 |
| 5,709,986 | 1/1998 | Smith et al. | 430/531 |

*Primary Examiner*—John Goodrow
*Attorney, Agent, or Firm*—Carl F. Ruoff

[57] ABSTRACT

The present invention is an imaged photographic element having a protective overcoat thereon. The protective overcoat formed by the steps of providing a photographic element having at least one silver halide light-sensitive emulsion layer; applying a coating comprising hydrophobic polymer particles having an average size of 0.01 to 1 microns, a melting temperature of from 55° to 200° C. at a weight percent of 30 to 95, and gelatin at a weight percent of 5 to 70 over the at least one silver halide light-sensitive emulsion layer. The silver halide light sensitive emulsion layer is developed to provide an imaged photographic element. The hydrophobic polymer particles are then fused to form a protective overcoat. In an alternate embodiment the coating further includes water soluble polymer materials at a weight percent of from 5 to 45.

17 Claims, No Drawings

WATER-RESISTANT PROTECTIVE OVERCOAT FOR AGX PHOTOGRAPHIC SYSTEM

CROSS REFERENCE TO RELATED APPLICATIONS

This application relates to commonly assigned copending application Ser. No. 08,898,987, filed simultaneously herewith and hereby incorporated by reference for all that it discloses.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. The application of UV-polymerizable monomers and oligomers on processed image followed by radiation exposure to form crosslinked protective layer is described U.S. Pat. Nos. 4,092,173, 4,171,979, 4,333,998 and 4,426,431. One drawback for the solvent coating method and the radiation cure method is the health and environmental concern of those chemicals to the coating operator. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistat property of the $V_2O_5$ layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

There remains a need for an aqueous coatable, water-resistant protective overcoat that can be incorporated into the photographic product, allows for appropriate diffusion of photographic processing solutions, and does not require coating operation after exposure and processing.

SUMMARY OF THE INVENTION

The present invention is an imaged photographic element having a protective overcoat thereon. The protective overcoat formed by the steps of providing a photographic element having at least one silver halide light-sensitive emulsion layer; applying a coating comprising hydrophobic polymer particles having an average size of 0.01 to 1 microns, a melting temperature of from 55° to 200° C. at a weight percent of 30 to 95, and gelatin at a weight percent of 5 to 70 over the at least one silver halide light-sensitive emulsion layer. The silver halide light sensitive emulsion layer is developed to provide an imaged photographic element. The hydrophobic polymer particles are then fused to form a protective overcoat. In an alternate embodiment the coating further includes water soluble polymer materials at a weight percent of from 5 to 45.

DESCRIPTION OF THE PREFERRED EMBODIMENTS

The present invention provides a novel overcoat formulation to the emulsion side of photographic products, particularly photographic prints, which encounters frequent handling and abuse by end users. The overcoat formulation of the present invention includes 30–95% by weight (based on the dry laydown of the overcoat) of hydrophobic polymer particles having an average size of 0.01–1 microns, preferably 0.01 to 0.5 microns and 5–70% by weight (based on the dry laydown of the overcoat) of gelatin as binder. Gelatin includes lime processed gelatin, acid processed gelatin and modified gelatin as described in U.S. Pat. Nos. 5,219,992 and 5,316,902. Other common addenda, such as hardeners, spreading agents, charge control agents, dry scratch resistance compounds and lubricants can also be included in the formulation as needed. The hydrophobic polymer of this invention has melting temperature (Tm) of 55°–200° C., and forms a water-resistant layer by fusing the polymer particles at a temperature above the Tm after the sample has been processed to generate the image. Since the particle size of polymer is small, the overcoat layer will not adversely affect the sharpness of the image due to light scattering, as observed by other large particle fillers. The presence of 5–70% by weight of gelatin is sufficient to allow proper permeability for processing solution to diffuse in and out for image development and also retain particles in the layer during processing. The coating solution is aqueous and can be incorporated in the manufacturing coating operation without any equipment modification. The fusing step is simple and environmentally friendly to photofinishing laboratories. Polymer of choice can be any hydrophobic polymer or copolymer as long as the melting temperature is above 55° C. and below 200° C. The lower limit is to prevent premature coalescence from occuring prior to photographic processing, and the upper limit is to prevent destruction of the paper support and imaging chemicals during fusing. These types of hydrophobic particles (polymers) include dispersion of submicron size, from 0.01 μm to 1 μm wax particles such as those offered commercially as aqueous or non-aqueous dispersions of polyolefins, polypropylene, polyethylene, high density polyethylene, oxidized polyethylene, ethylene acrylic acid copolymers, microcrystalline wax, paraffin, and natural waxes such as camauba wax, and aqueous dispersions of synthetic waxes from such companies as, but not limited to, Chemical Corporation of America (Chemcor), Inc., Michelman Inc., Shamrock Technologies Inc., Daniel Products Company. The dispersion may also contain dispersing aids such as polyethylene glycol.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The present invention is illustrated by the following examples.

EXAMPLES

Sample Preparation

Sample No.1 was prepared by coating in the following layers in sequence; blue-light sensitive layer, interlayer, green-light sensitive layer, UV layer, red-light sensitive layer, UV layer and overcoat on photographic paper support. The components in each individual layer are described below. Other samples were prepared identical to sample No. 1 except the overcoat composition was changed.

| Layer | Laydown (mg/sq. ft.) |
|---|---|
| Overcoat | 120.0 gelatin |
| | 1.0 SURF-1 |
| | 0.39 SURF-2 |
| | 8.87 HAR-1 |
| UV | 12.11 UV-1 |
| | 2.13 UV-2 |
| | 3.57 SCV-1 |
| | 2.37 S-1 |
| | 2.37 S-2 |
| | 47.5 Gelatin |
| Cyan | 18.1 Red light sensitive AgX |
| | 39.31 C-1 |
| | 38.52 S-2 |
| | 3.22 S-3 |
| | 25.31 UV-1 |
| | 129.0 Gelatin |
| UV | 17.43 UV-1 |
| | 3.07 UV-2 |
| | 5.14 SCV-1 |
| | 3.41 S-1 |
| | 3.41 S-2 |
| | 68.4 Gelatin |
| Magenta | 7.70 Green-light sensitive AgX |
| | 1.11 KCL |
| | 29.5 C-2 |
| | 8.26 S-2 |
| | 3.54 S-4 |
| | 17.7 ST-1 |
| | 2.01 ST-2 |
| | 57.0 ST-3 |
| | 0.05 FOG-1 |
| | 0.285 Nitric Acid |
| | 117.0 Gelatin |
| IL | 6.12 SCV-1 |
| | 18.4 S-2 |
| | 6.025 3,5-Disulfocatechol disodium salt |
| | 0.524 Nitric Acid |
| | 0.18 SURF-1 |
| | 70.0 Gelatin |
| Yellow | 24.0 Blue-light sensitive AgX |
| | 45.0 C-3 |
| | 45.0 P-1 |
| | 20.3 S-2 |
| | 0.88 SCV-2 |
| | 141.8 Gelatin |

Photographic paper support
sublayer 1: resin coat (Titanox and optic brightener in polyethylene)
sublayer 2: paper
sublayer 3: resin coat (polyethylene)

C-1 Butanamide 2-[2,4-bis(1,1-dimethylpropl)phenoxy]-N-(3,5-dichloro-4-ethyl-2-hydroxyphenyl)

C-2

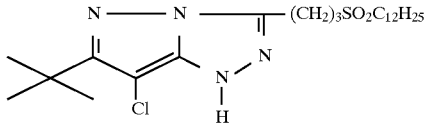

C-3

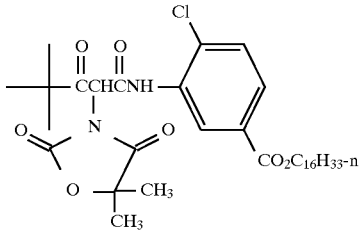

-continued

| Layer | Laydown (mg/sq. ft.) |
|---|---|
| FOG-1 | 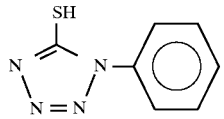 |
| HAR-1 | 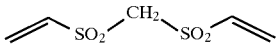 |
| P-1 | 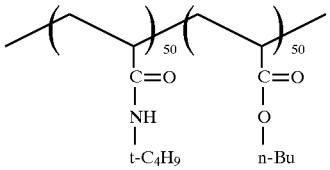 |
| S-1 | 1,4-Cyclohexylenedimethylene bis(2-ethylhexaneoate) |
| S-2 | 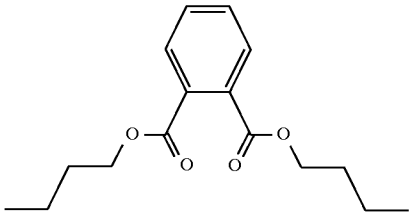 |
| S-3 | 2-(2-Butoxyethoxy)ethyl acetate |
| S-4 | Di-undecylphthalate |
| SCV-1 | 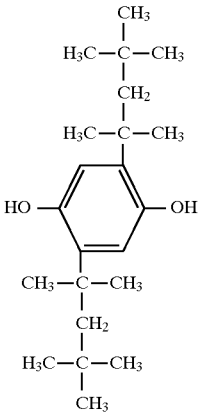 |
| SCV-2 | benzenesulfonic acid 2,5-dihydroxy-4-(1-methylheptadecyl)-mono-potassium salt |
| ST-1 | 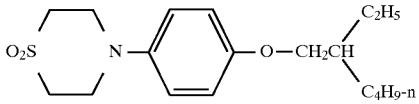 |
| ST-2 | 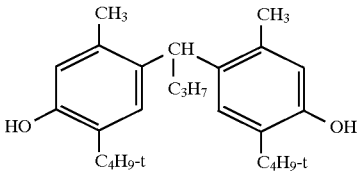 |

-continued

| Layer | Laydown (mg/sq. ft.) |
|---|---|
| ST-3 | 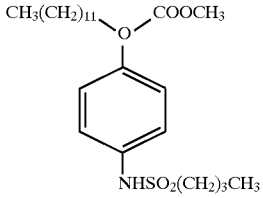 |
| SURF-1 | 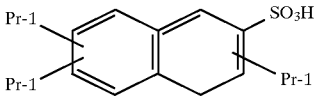 .1 Na |
| SURF-2 | $C_8F_{17}SO_3N(C_2H_5)_4$ |
| UV-1 | 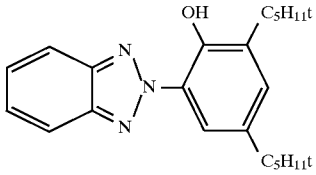 |
| UV-2 | 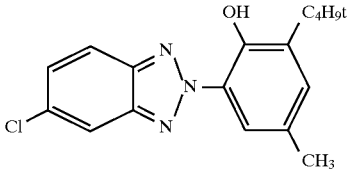 |

Study of Dye Density Development by RA4 Process

After the samples were fully hardened (at least 3 days after coating), they were exposed to 1/10 seconds of daylight of color temperature 3000K, through 0–3 density step chart in combination with a WR98 filter (blue light) and a heat absorbing filter. In the case of red light and green light, WR29 and WR99 filters were used respectively. After exposure, samples were processed with the Kodak RA4 process to generate color density. The assessment of developability was done by comparing the DlogE curves of each color record, particularly the yellow layer, to the check coating (sample No.1 containing only gelatin in the overcoat). Lower dye density is the indicative of slow developability.

Test for Water Resistance

Ponceau Red dye is known to stain gelatin through ionic interaction, therefore it is used to test water resistance. Ponceau red dye solution was prepared by dissolving 1 gram dye in 1000 grams mixture of acetic acid and water (5 parts: 95 parts). Samples, without being exposed to light, were processed through the Kodak RA4 process to obtain white Dmin samples. These processed samples were then passed through a set of heated pressurized rollers (fusing) to convert the polymer particles of the overcoat into a water resistant layer. The water permeability was done by soaking fused samples in the dye solution for 5 minutes followed by a 30-second water rinse to removed excess dye solution on the coating surface. Each sample was then air dried, and status A reflectance density on the soaked area was recorded. Optical density of 3 indicates a completely water permeable coating, such as sample No.1, its water resistance=0%. Relative to an optical density of 3 (sample No.1) being 0% water resistance and an optical density of 0 being 100% water resistant, the percent water resistance is calculated by the following equation.

$$\% \text{ water resistance} = 1 - (\text{status A density}/3)$$

Example 1

The polymer particles used to demonstrate this invention and their properties are listed below.

| Polymer particles | composition | particle size (in water, microns) | Tm (°C.)* |
|---|---|---|---|
| ME02925 (from Michelman) | Poly(ethylene-co-acrylic acid) | 0.045 | 95 |
| ME39235 (from Michelman) | high density polyethylene | 0.040 | 129 |
| PE392N35 (from ChemCor) | high density polyethylene | 0.050 | 131 |

*The melting temperature (Tm) of the polymer particles was determined by differential scanning calorimetry (DSC), using a ramping rate of 20° C./minute. Tm is defined herein as the peak of the melting transition.

The following samples were prepared and tested for image developability.

TABLE 1

| Sample ID | Overcoat Composition (in mg/sq. ft.) | Note | Yellow layer image developability |
|---|---|---|---|
| 1 | 120 gel | comparison | 98% |
| 2 | 30 gel + 60 ME02925 | invention | 98% |
| 3 | 30 gel + 90 ME02925 | invention | 98% |
| 4 | 30 gel + 120 ME02925 | invention | 98% |
| 5 | 40 gel + 60 ME02925 | invention | 100% |
| 6 | 40 gel + 90 ME02925 | invention | 98% |
| 7 | 40 gel + 120 ME02925 | invention | 97% |
| 8 | 40 gel + 160 ME02925 | invention | 97% |
| 9 | 50 gel + 60 ME02925 | invention | 99% |
| 10 | 50 gel + 90 ME02925 | invention | 98% |
| 11 | 50 gel + 120 ME02925 | invention | 97% |
| 12 | 50 gel + 160 ME02925 | invention | 97% |
| 13 | 40 gel + 60 ME39253 | invention | 99% |
| 14 | 40 gel + 90 ME39253 | invention | 100% |
| 15 | 40 gel + 120 ME39253 | invention | 99% |
| 16 | 40 gel + 160 ME39253 | invention | 99% |
| 17 | 40 gel + 60 PE392N35 | invention | 100% |
| 18 | 40 gel + 90 PE392N35 | invention | 97% |
| 19 | 40 gel + 120 PE392N35 | invention | 98% |
| 20 | 40 gel + 160 PE392N35 | invention | 97% |
| C-1 | 60 gel + 60 Latex 1 | comparison | 100% |
| C-2 | 20 gel + 100 Latex 1 | comparison | 100% |

For comparison, C-1 and C-2 were prepared. Latex 1 is a copolymer latex of approximately 80 nm average particle size, its composition is 95% of butylacrylate and 5% 2-sulfo-1,1-dimethylethyl acrylamide, sodium salt. This latex has a glass transition of −50° C. and no melting temperature as it is not a crystalline polymer.

As shown in the table 1, the developability of image layers remained acceptable for samples containing as high as 80% hydrophobic particles in the overcoat.

Example 2

Samples as described in example 1 were processed by the Kodak RA4 process, dried, then passed through a set of heated pressurized roller (operating at a pressure of 65 psi and varying temperatures) and their water resistance after fusing (as tested by dye staining) was reported in Table 2.

TABLE 2

| Sample ID | Tm of polymeric particles (C.) | Water Resistance after Fused @ 100° C. | Fused @ 110° C. | Fused @ 130° C. | Fused @ 150° C. |
|---|---|---|---|---|---|
| 1 | no particles (comparison) | 0% | 0% | 0% | 0% |
| 2 | 95° C. | 12% | 22% | 66% | 46% |
| 3 | 95° C. | 80% | 85% | 83% | 77% |
| 4 | 95° C. | 77% | 72% | 92% | 79% |
| 5 | 95° C. | 29% | 56% | 77% | 56% |
| 6 | 95° C. | 64% | 74% | 81% | 92% |
| 7 | 95° C. | 68% | 89% | 78% | 74% |
| 8 | 95° C. | 39% | 93% | 94% | 94% |
| 9 | 95° C. | 23% | 46% | 71% | 66% |
| 10 | 95° C. | 62% | 62% | 66% | 72% |
| 11 | 95° C. | 24% | 55% | 82% | 87% |
| 12 | 95° C. | 19% | 56% | 94% | 95% |
| 13 | 129° C. | 6% | 7% | 36% | 21% |
| 14 | 129° C. | 6% | 6% | 30% | 68% |
| 15 | 129° C. | 5% | 9% | 47% | 76% |
| 16 | 129° C. | 28% | 25% | 77% | 90% |
| 17 | 131° C. | 0% | 0% | 38% | 78% |
| 18 | 131° C. | 7% | 2% | 47% | 91% |
| 19 | 131° C. | 6% | 2% | 29% | 95% |
| 20 | 131° C. | 16% | 9% | 20% | 94% |
| C-1 | no Tm (Tg = 50° C.) | 0% | 0% | 0% | 0% |
| C-2 | no Tm (Tg = 50° C.) | 0% | 0% | 0% | 0% |

As shown in Table 2, the water resistance of photographic coating is greatly improved after fusing the coatings of invention. The improvement is especially pronounced after coatings being fused at a temperature higher then the Tm of polymeric particles incorporated in the overcoat. Those coatings containing latex (C-1 and C-2) do not show any improvement in water resistance.

The trend in the photographic processing industry is to reduce processing times, which requires faster developability of AgX emulsions. The formulation of the overcoat of the present invention does not hinder the developability under the current processing conditions and development times. For example, current RA4 process is done at 98° F. and 45 seconds time of development (TOD) in the T-213 developer. However, data indicates that the developability of yellow layer, which is coated in the bottom of the multilayer structure of color paper, is somewhat hindered by the incorporation of polymeric particles in the overcoat.

The incorporation of water soluble polymers at 5–45% by weight based on the total dry laydown of the overcoat layer can improve the developability and dye formation rate of the imaging formation layer, especially noticeable for the layers closer to the support. During processing, the water soluble polymers are removed from the coating and therefore do not interfere with the formation of water resistance layer by fusing treatment. The average molecular weight of the water-soluble polymers is between 1,000 and 200,000, preferably between 1,500 and 20,000. Other than polyacrylamides shown in the example above, a wide variety of nonionic, anionic or cationic water soluble polymers can also be used in the present invention including polymethacrylamide, poly(acrylic acid), poly(methacrylic acid), poly(ethylene oxide), poly(oxymethylene), poly(vinyl alcohol), polyvinylamine, polyvinylpyrrolidone, poly(vinyl pyridine), poly(ethylene imine), poly(ethylene glycol methacrylate), poly(hydroxyethyl methacrylate), poly(vinyl methyl ether), poly(styrene sulfonic acid), poly(ethylene sulfonic acid), poly(vinyl phosphoric acid), poly(maleic acid), or copolymers containing sufficient amount of hydrophilic functional groups to be water soluble.

The multilayer-structured sample preparation is identical as described in Examples 1 and 2.

Example 3

The following samples were prepared with the overcoat variations described below. Samples before photographic processing (RA-4) and after photographic processing were submitted for high performance liquid chromatography (HIPLC) analysis* to determine the presence of water soluble polymers. The results are also shown below.

TABLE 3

| Sample ID | Water soluble polymer | Average M.W. | Aimed Laydown in overcoat (mg/sq. ft.) | amount detected by HPLC on unprocessed sample | amount detected by HPLC on RA4 processed sample |
|---|---|---|---|---|---|
| 3-1 | Polyacrylamide Cyanamer ® N-10 | 1,500 | 20 | 20.3 | none |
| 3-2 | Polyacrylamide Cyanamer ® N-10 | 1,500 | 30 | 30.1 | none |
| 3-3 | Polyacrylamide Cyanamer ® N-10 | 1,500 | 40 | 34.2 | none |
| 3-4 | Polyacrylamide Cyanamer ® N-100L | 10,000 | 40 | 36.9 | none |

*HPLC detection limit for N-10 and N-100L is 1.2 mg/sq. ft., the correlation coefficient is R2 = 0.999

As indicated in the Table 3, polyacrylamide was completed removed for both high and low molecular weight variations from the coating by photographic process RA4.

Example 4

The following samples were prepared with the variations in the overcoat composition described below. The dye formation at varying TOD was measured and listed.

TABLE 4

| Sample ID | Overcoat Composition (in mg/sq. ft.) Gelatin | Polymer particle ML02925 | Cyanamer N-10 | Developability of Yellow image layer TOD = 15 seconds | TOD = 30 seconds | TOD = 45 seconds |
|---|---|---|---|---|---|---|
| 4-1 | 120 | 0 | 0 | 40% | 90% | 100% |
| 4-5 | 30 | 70 | 0 | 38% | 96% | 99% |
| 4-6 | 30 | 70 | 20 | 45% | 99% | 100% |
| 4-8 | 40 | 60 | 0 | 21% | 95% | 99% |
| 4-9 | 40 | 60 | 20 | 32% | 86% | 100% |
| 4-10 | 40 | 60 | 40 | 26% | 97% | 98% |
| 4-11 | 40 | 160 | 0 | 7% | 78% | 98% |
| 4-12 | 40 | 160 | 40 | 16% | 93% | 98% |
| 4-13 | 40 | 160 | 80 | 20% | 95% | 98% |
| 4-14 | 60 | 140 | 0 | 15% | 91% | 96% |
| 4-15 | 60 | 140 | 40 | 23% | 96% | 97% |
| 4-16 | 60 | 140 | 80 | 21% | 98% | 95% |
| 4-17 | 80 | 120 | 0 | 17% | 95% | 95% |
| 4-18 | 80 | 120 | 40 | 22% | 92% | 98% |
| 4-19 | 80 | 120 | 80 | 27% | 94% | 95% |

Sample 4-1 is the comparison without any polymer particles in the overcoat layer. It does not have any water resistance property, but its high developability is desirable. Samples 4-5, 4-8, 4-11, 4-14, 4-17 are the comparison where polymer particles are incorporated in the overcoat to obtain water resistance property as described previously; however, these samples suffer from low developability, especially noticeable in the short TOD, e.g. TOD=15 seconds. Other samples (4-6, 4-9, 4-10, 4-12, 4-13, 4-15, 4-16, 4-18 and 4-19) water soluble polymers along with the water insoluble polymer particles in order to obtain the water resistance property on fusing (see example 5 for this property) without significant degradation in the developability of emulsion layers.

Example 5

Samples 4-1 to 4-25 were fused at 65 psi and varying temperatures after being processed through RA4 process. Dye staining test was carried out on these samples and water resistance was calculated as described previously.

TABLE 5

| Sample ID | Overcoat Composition (in mg/sq. ft.) Gelatin | Polymer particle ME02925 | Cyanamer N-10 | Water Resistance fused @110° C. | fused @130° C. | fused @150° C. |
|---|---|---|---|---|---|---|
| 4-1 | 120 | 0 | 0 | 0% | 0% | 0% |
| 4-2 | 20 | 80 | 0 | 88% | 90% | 89% |
| 4-3 | 20 | 80 | 20 | 94% | 94% | 89% |
| 4-4 | 20 | 80 | 40 | 90% | 65% | 61% |
| 4-5 | 30 | 70 | 0 | 92% | 90% | 84% |
| 4-6 | 30 | 70 | 20 | 92% | 90% | 27% |
| 4-7 | 30 | 70 | 40 | 90% | 93% | 84% |
| 4-8 | 40 | 60 | 0 | 93% | 94% | 71% |
| 4-9 | 40 | 60 | 20 | | 93% | 86% |
| 4-11 | 40 | 160 | 0 | 93% | 96% | 93% |
| 4-13 | 40 | 160 | 80 | 94% | 96% | 94% |
| 4-14 | 60 | 140 | 0 | 25% | 95% | 93% |
| 4-16 | 60 | 140 | 80 | 95% | 95% | 90% |
| 4-17 | 80 | 120 | 0 | 16% | 20% | 18% |
| 4-18 | 80 | 120 | 40 | 18% | 24% | 17% |
| 4-19 | 80 | 120 | 80 | 94% | 96% | 92% |
| **Sample ID** | **Gelatin** | **Polymer particle PE392N35** | **Cyanamer N-10** | **fused @110° C.** | **fused @130° C.** | **fused @150° C.** |
| 4-20 | 20 | 80 | 0 | 5% | 5% | 80% |
| 4-21 | 20 | 80 | 20 | 13% | 8% | 88% |
| 4-23 | 40 | 160 | 0 | 7% | 8% | 94% |
| 4-25 | 40 | 160 | 80 | 10% | 24% | 88% |

As shown in Table 5, the addition of water soluble polymers in the overcoat does not degrade the formation of water resistance layer after coatings have been processed to generate photographic images, in some cases (4-16 compared to 4-14, 4-19 compared to 4-17), it actually helps to improve the water resistance property.

The invention has been described in detail with particular reference to certain preferred embodiments thereof, but it will be understood that variations and modifications can be effected within the spirit and scope of the invention.

What is claimed is:

1. An imaged photographic element having a protective overcoat thereon, the protective overcoat formed by the steps comprising;

providing a photographic element having at least one silver halide light-sensitive emulsion layer;

applying a coating comprising hydrophobic polymer particles having an average size of 0.01 to 1 microns, a melting temperature of from 55° to 200° C. at a weight percent of 30 to 95, and gelatin at a weight percent of 5 to 70 over the at least one silver halide light-sensitive emulsion layer;

developing the at least one silver halide light sensitive emulsion layer to provide an imaged photographic element; and fusing the hydrophobic polymer particles to form a protective overcoat.

2. The imaged photographic element having the protective overcoat of claim 1 wherein the fusing comprises the application of heat.

3. The imaged photographic element having the protective overcoat of claim 1 wherein the fusing comprises the application of heat and pressure.

4. The imaged photographic element having the protective overcoat of claim 1 wherein the size of hydrophobic polymer particles is between 0.01 and 1.0 microns, more preferably between 0.01 to 0.5 microns.

5. The imaged photographic element having the protective overcoat of claim 1 wherein the hydrophobic polymer particles comprise a polymer selected from the group consisting of polyolefins, polypropylenes, polyethylenes, high density polyethylenes, oxidized polyethylenes, ethylene acrylic acid copolymers, microcrystalline waxes, paraffin, and natural waxes.

6. The imaged photographic element having the protective overcoat of claim 1 wherein the imaged photographic element is a photographic image on a transparent support.

7. The imaged photographic element having the protective overcoat of claim 1 wherein the imaged photographic element is a photographic image on a reflective support.

8. The imaged photographic element having the protective overcoat of claim 1 wherein the at least one silver halide emulsion layer is applied simultaneously with the applying the coating composition.

9. An imaged photographic element having a protective overcoat thereon, the protective overcoat formed by the steps comprising;

providing a photographic element having at least one silver halide light-sensitive emulsion layer;

applying a coating comprising hydrophobic polymer particles having an average size of 0.01 to 0.5 microns, a melting temperature of from 55° to 200° C. at a weight percent of 30 to 95, water soluble polymer materials at a weight percent of 5–45%, and gelatin at a weight percent of 5 to 70 over the at least one silver halide light-sensitive emulsion layer;

developing the at least one silver halide light sensitive emulsion layer to provide an imaged photographic element; and fusing the hydrophobic polymer particles to form a protective overcoat.

10. The imaged photographic element having the protective overcoat of claim 9 wherein the fusing comprises the application of heat.

11. The imaged photographic element having the protective overcoat of claim 9 wherein the fusing comprises the application of heat and pressure.

12. The imaged photographic element having the protective overcoat of claim 9 wherein the size of hydrophobic polymer particles is between 0.01 and 1.0 microns, more preferably between 0.01 to 0.5 microns.

13. The imaged photographic element having the protective overcoat of claim 9 wherein the water soluble polymer materials are selected from the group consisting of polyacrylamide, polymethacrylamide, poly(acrylic acid), poly(methacrylic acid), poly(ethylene oxide), poly (oxymethylene), poly(vinyl alcohol), polyvinylamine, polyvinylpyrrolidone, poly(vinyl pyridine), poly(ethylene imine), poly(ethylene glycol methacrylate), poly (hydroxyethyl methacrylate), poly(vinyl methyl ether), poly (styrene sulfonic acid), poly(ethylene sulfonic acid), poly (vinyl phosphoric acid) and poly(maleic acid).

14. The imaged photographic element having the protective overcoat of claim 9 wherein the water soluble polymer materials have a molecular weight of from 1,000 to 200,000, preferably from 1,500 to 20,000.

15. The imaged photographic element having the protective overcoat of claim 9 wherein the hydrophobic polymer particles comprise a polymer selected from the group consisting of polyolefins, polypropylenes, polyethylenes, high density polyethylenes, oxidized polyethylenes, ethylene acrylic acid copolymers, microcrystalline waxes, paraffin, and natural waxes.

16. The imaged photographic element having the protective overcoat of claim 9 wherein the imaged photographic element is a photographic image on a transparent support.

17. The imaged photographic element having the protective overcoat of claim 9 wherein the imaged photographic element is a photographic image on a reflective support.

* * * * *